United States Patent [19]

Beck

[11] 4,388,619

[45] Jun. 14, 1983

[54] CORRECTOR FOR BUNDLE DEFLECTION DISTORTION IN MULTIBEAM CATHODE RAY TUBES

[75] Inventor: Vernon D. Beck, Ridgefield, Conn.

[73] Assignee: International Business Machines Corporation, Armonk, N.Y.

[21] Appl. No.: 279,280

[22] Filed: Jun. 30, 1981

[51] Int. Cl.[3] ..... G09G 1/20

[52] U.S. Cl. ..... 340/727; 315/371; 315/382; 340/724; 340/812

[58] Field of Search ..... 340/727, 724, 812; 315/371, 382, 399

[56] References Cited

U.S. PATENT DOCUMENTS

| | | | |
|---|---|---|---|
| 2,539,492 | 1/1951 | Smyth | 315/382 |
| 2,574,946 | 11/1951 | White | 315/371 |
| 3,421,044 | 1/1969 | Murdock et al. | 340/727 X |
| 3,487,164 | 12/1969 | Eggert | 315/371 X |
| 3,961,223 | 6/1976 | Ray et al. | 315/382 X |

*Primary Examiner*—David L. Trafton

*Attorney, Agent, or Firm*—Roy R. Schlemmer

[57] ABSTRACT

A multibeam matrix array cathode ray tube having diminished rotational and focused distortion. In a multibeam cathode ray tube having a flat or planar electron beam emitter means arranged to project a two-dimensional array of beams, deflection means and stigmator correction means are provided. In addition, a novel split focus coil is provided for correcting distortion due to undesired rotation of the array of beams. By dynamically supplying opposing currents in the two halves of the split focus coil, rotational distortion may be compensated for, while adjustments are automatically made for changes of focus due to the introduction of rotational correction. Correctional currents are dynamically supplied to the split coils as a function of the matrix beam displacement on the cathode ray tube face.

8 Claims, 5 Drawing Figures

CORRECTOR FOR BUNDLE DEFLECTION DISTORTION IN MULTIBEAM CATHODE RAY TUBES

FIELD OF THE INVENTION

The present invention is directed to improvements in multibeam cathode ray tubes, and more particularly to such multiple beam cathode ray tubes which project a matrix type beam array having reduced rotation and focus distortion.

BACKGROUND OF THE INVENTION

Multiple beam cathode ray tubes are frequently used to display alphanumeric and/or other types of visual pattern information. Each of the multiple beams concurrently produces scan lines on the face of the tube and consequently, such tubes have a greater bandwidth than single beam tubes, which enables them to display more information at suitable brightness than a single beam type of tube.

Typical multiple beam cathode ray array tubes utilized in the prior art arrange a plurality of closely spaced cathodes in a vertical column array (collinear) to produce a vertical column array of closely spaced electron beams. Accelerating means, focusing means and deflection means are disposed within the envelope of the cathode ray tube or surrounding same. Normally, the individual beams are accelerated, focused and deflected across the screen and are repeatedly being turned on and off with a suitable video signal to form dots on the screen at appropriate scanning locations. It is well known to form the desired character or other pattern, utilizing logic circuitry within the video portion of the system to selectively control each beam to be either on or off at various scanning positions, and the resulting arrangement of variable intensity dots forms the desired pattern. A general problem encountered with multiple beam cathode ray tubes is that of off-axis aberrations or distortions. Since only one beam can be emitted along the axis of the tube, the remainder of the beams in the multiple beam tube are off-axis by varying amounts. The distortions or aberrations are caused by nonuniformities in the deflection and focusing fields, and these nonuniformities cause the distortions in the projected beams to increase with distance from the axis.

According to known electronic principles, in conventional multiple beam tubes, beams are emitted parallel to the axis and are accelerated in the same direction to the focusing means or lens, which changes the direction of the beams and causes them to converge toward a crossover point which is normally located in the funnel portion of the tube.

In prior art collinear multiple beam cathode ray tubes, parallel beams are spaced from each other by a substantial distance, resulting in a relatively large maximum off-axis distance as the beams traverse the focusing means, and due to the fact that the beams do not cross until they are well into the funnel portion of the tube, a relatively large amount of off-axis distance results as the converging beams traverse the deflection means. The magnetic deflection yoke is the component in such systems which introduces the largest single aberration due to fringing fields and the like, and this distortion is most severe when a large deflection angle is utilized in the tube which permits the length of the tube to be minimized for a given screen size. The off-axis aberrations caused by such conventional arrangements as described above make it very difficult to focus the beams at all locations on the screen and have proven to be quite troublesome.

In addition to problems of focus, such multiple beam cathode ray tubes suffer from two other well known distortions. These are shear and rotation. Shear is in effect a quadrature distortion and results in a distortion of the projected matrix wherein a compression is caused along one axis of the matrix accompanied by an expansion along the other. Thus, a graphical illustration of shear distortion is to consider a square matrix of beams being projected upon the screen. Due to the shear, the projected matrix would not be square. Thus, the shear distorted square would be forced into a rhombus, and in another form of shear distortion the square might be converted into a nonequilateral parallelogram or rectangle. Quadrature compensation stigmators or quadrapoles have been used in prior art systems. In prior art collinear multiple beam cathode ray tubes, shear distortion is indistinguishable from rotation of the linear array on the screen of the tube. The quadrapole correction currents could usually be adjusted to achieve reasonable correction of this form of distortion.

With multiple beam cathode ray tubes which actually project a two-dimensional matrix type of array on the screen, quadraple shear correction does not correct for actual rotation of the complete matrix caused by traversing the focusing and deflection coil.

Two-dimensional matrix array beams are known in the art to be more desirable than a linear array due to the fact that the individual cathode and other beam forming structures can be spaced a greater distance apart within the cathode or electron beam emissive structure to allow for the formation of a much narrower and better defined beam without interference from other nearby structures. Further, because the beams are very close together in a collinear array, and may actually touch each other, mutual beam repulsion results, which may cause the top and bottom beams to be deflected upwardly and downwardly, respectively when the beams are turned on. Also, since the beams are located very close to each other, there is little space to build and mount the grids which control the intensity of the beams. Finally, the closeness of the beams places an effective limit on the amount of current which each beam may contain and also results in beam intermodulation, wherein the control grid of one beam may affect or intermodulate the current of another beam, thereby precluding effective grid control. The above problems are obviated by a matrix electron beam array instead of a collinear array.

Thus, a 4×4 matrix array may be utilized to form sixteen very closely spaced scan lines by rotating the matrix a predetermined amount so that the horizontal scan lines produced by the beams are equally spaced. Suitable delays may be introduced in the individual beam modulation circuits to, in effect, present a vertical scan line across said screen. To the observer, there appears to be a vertical line scan by all sixteen beams. Such matrix arrays can undergo rotation and shear distortions which are distinguishable. In the single beam or collinear case shear and rotation are indistinguishable.

DESCRIPTION OF THE PRIOR ART

There are numerous examples in the prior art of various types of compensating coils which have been used in cathode ray tubes to correct for different types of distortion or aberrations.

Russian Pat. No. 284 185 discloses a plurality of heated cathodes arranged in a collinear fashion. The Russian patent discloses a focusing coil and is directed solely to the problem of focusing in a multiple beam cathode ray tube.

U.S. Pat. No. 3,150,284 discloses a uniquely shaped current carrying conductor which is stated to simultaneously correct for focus and astigmatic distortion. Due to the unique shape of the conductor, it produces both quadrupole fields which are necessary to correct astigmatism and also a lens field to correct focus.

U.S. Pat. No. 2,907,908 discloses a collinear multibeam cathode ray tube utilizing stigmators of a more or less conventional type to correct for an apparent rotation.

None of the cited references are specifically concerned with the simultaneous correction of focus and rotational distortions in a collinear multibeam cathode ray tube. This is due in large part to the fact that when the array is collinear, stigmators correct for apparent rotational distortions. However, with multibeam cathode ray tubes which project a matrix array of beams, rotational distortion constitutes a major problem, a suitable correction for which must be provided.

SUMMARY OF THE INVENTION

It is accordingly a primary object of the present invention to provide an improved multiple beam matrix array cathode ray tube which has reduced off-axis aberrations.

It is a further object of the invention to provide such a cathode ray tube having reduced rotational and focus distortion.

It is yet another object of the invention to provide such a multibeam cathode ray tube utilizing a split focus coil.

A still further object of the invention is to provide such a multibeam cathode ray tube having means for dynamically energizing said split focus coils and for balancing the currents within said coils so that when adjustments are made to correct rotational distortions any tendency to introduce focus distortion will be substantially eliminated and vice versa.

The objects of the present invention are accomplished in general by a multibeam cathode ray display tube comprising an array of cathodes and beam forming means for projecting a matrix array of electron beams onto the screen of said display tube. Means are provided for simultaneously deflecting said array of electron beams. Means are provided in an electromagnetically interactive relationship with said array of electron beams for simultaneously focusing each of said electron beams in said array to a desired spot size and for rotating said entire bundle of electron beams by an amount sufficient to counter rotational distortion of said bundle normally inherent in such structures.

More particularly, the means for electromagnetically interacting with said array of electron beams comprises a split focus coil having separately energizable windings. Further means are supplied for dynamically energizing the two windings of said split focus coil as a function of the instantaneous location of the projected array of beams on the screen of said display tube.

Utilizing the teachings of the present invention, it is possible to continuously correct the array of beams for rotational deflection as it forms a complete scan of the display tube. Also, provision is made for eliminating any tendency for focus distortion which would occur if rotational corrections alone were made. Thus, continuous focus correction is made simultaneously with correction for rotation.

DESCRIPTION OF THE PREFERRED EMBODIMENT

The present invention is predicated upon the discovery that array distortions in multiple beam cathode ray tubes are substantially linear. It has been further found that these distortions may be corrected utilizing relatively conventional electron optic components in a nonconventional way. The resulting multibeam cathode ray tube uses a split magnetic focus lens which produces two regions of opposed axial magnetic field.

It has been further found that by appropriately winding the two halves of the split lens that currents in the two regions or halves of the lens may be adjusted to produce rotation without changing focus and conversely to change focus without affecting the rotation.

It has been further found that the use of fixed corrective currents in the split focus coils does not provide completely adequate correction due to the nonlinear distortions that are imposed on such a matrix array of electron beams especially in wide angle tubes. Accordingly, means have been provided for dynamically energizing the corrective lenses by storing the corrective signals in digital form in an appropriate memory and continually accessing same during the production of a scan on the display of the cathode ray tube to produce the desired correctional currents as a function of the instantaneous displacement of the array of beams. This functional dependence, as will be understood more clearly from the subsequent description, is dependent not only on the horizontal but also on the vertical displacement of the beams.

Figure 1:
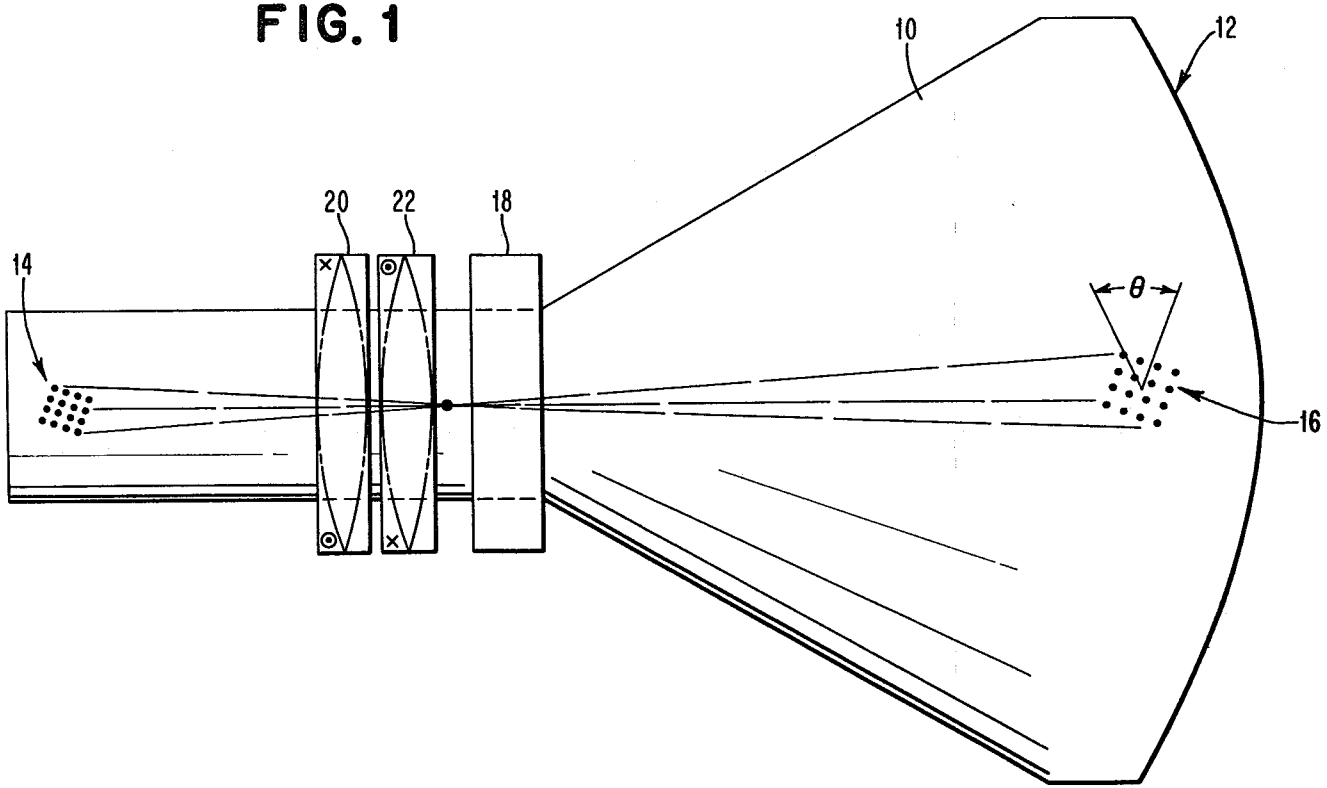
FIG. 1 is a schematic representation of a multibeam cathode ray tube including a cathode means suitable for projecting a matrix array of electron beams on the screen and having split focus coil means instructed in accordance with the teachings of the present invention.

Referring now to FIG. 1, there is disclosed a schematic representation of a multiple beam cathode ray tube constructed in accordance with the present invention. The tube comprises an envelope 10 having a screen area 12 and flat or planar cathode structure 14. This cathode structure produces a matrix array of electron beams which are projected on screen 12 in substantially the same form. This is indicated by the reference numeral 16. As will be clearly appreciated, both the cathode structure 14 and array 16 are shown in plan view for illustrative purposes only. It will be readily appreciated that they would appear to be a line when viewed from the side. The various beam forming mechanisms such as the acceleration electrodes, grids for modulating the individual beams with video information, etc., are not shown as they would be essentially conventional in nature and form no part of the present invention.

Cathode structures suitable for producing such matrix arrays of electron beams in a cathode ray tube are disclosed, for example, in U.S. patent application Ser. No. 148,899, of Depp et al., filed May 12, 1980. It is to be noted that the particular means for forming the matrix array of electron beams is not critical. The significant feature is that an actual M×N matrix array of beams is being projected as a bundle through the beam forming and deflection means and is thus subject to the various off-axis distortions discussed previously. Deflection coils 18 are shown generally and comprise conventional dipole coils for introducing x,y deflection of the bundle of electron beams to produce the requisite scan across the face of the tube. Coils 20 and 22 comprise the split focus coils of the present invention. The two symbols in the upper and the lower left-hand corners of each of the coils indicate that the sense of the primary windings in each coil is opposite whereby currents flowing in the coils in the indicated directions will produce magnetic fields within the envelope which oppose each other in the axial direction.

The bidirectional radial arrows shown on the displayed matrix 16 serve to illustrate that the entire matrix may be caused to rotate by some angle $\theta$ in accordance with the corrective currents applied to the two halves of the split focus coils 20 and 22.

While it is assumed that a square matrix, e.g., 4×4 as shown, is the preferred geometry, it will of course be understood that matrix-type arrays which are rectangular could equally well be used, i.e., 3×5, 4×5, 3×6, etc. Other two dimensional shapes could also be used. It is to be noted that a square matrix is chosen as it generally allows the most compact overall structure.

Figure 2:
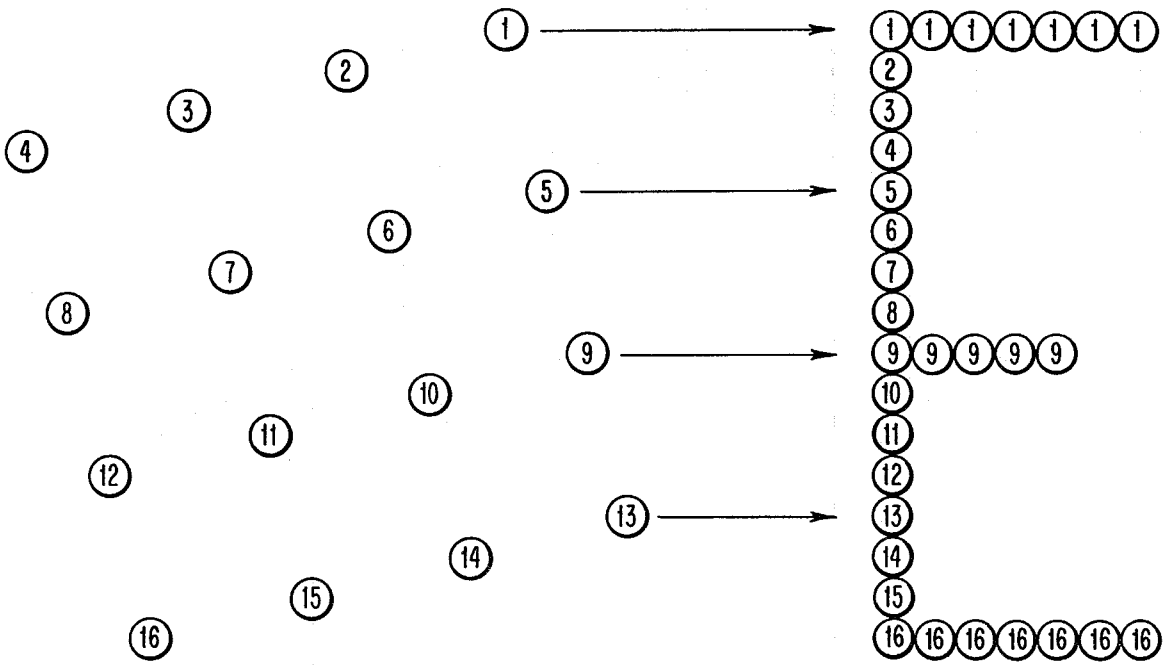
FIG. 2 comprises an illustrative diagram showing how the projected electron beam matrix on the face of the tube is utilized to form groups of evenly spaced scan lines. In turn, these may be selectively energized to form, for example, alphanumeric characters.

Referring now to FIG. 2, the way in which a typical alphanumeric character, i.e., the letter E is formed utilizing such electrode configuration is set forth graphically. Referring to the figure, the 16-numbered electron beams produce the 16 indicated pels forming the 16 vertical portions of the letter E. In order to produce this vertical line it is necessary that each beam unit be suitably biased so that as it passes the same horizontal point in the scan, it will be energized. This is conventionally done, as will be understood by those skilled in the art, by placing suitable time delays in the video circuitry. Thus, assuming that the scan of the matrix moves from left to right and the individual beams are numbered as shown in the left-hand portion of FIG. 2, the entire horizontal distance separating beam 4 from beam 13 represents the amount of time that the video signal energizing beam 4 must be delayed for it to be directly above the spot produced by beam 13, assuming there is no delay in beam 13. Assuming that all of the beams are equispaced horizontally as well as vertically the total time would be divided by 15 and a unit of time delay defined thereby. Thus the video signal to the control grid for beam 4 would be delayed 15 units, the signal for beam 8, 14 units; the signal for beam 12, 13 units; the signal for beam 16, 12 units, etc. These delayed signals would produce the desired vertical line or stroke on the face of the CRT. Such digital control circuitry for multibeam CRT tubes would be obvious to those skilled in the art. An exemplary beam control system is shown in copending U.S. patent application Ser. No. 205,615, by V. D. Beck, entitled "Apparatus and Method for Providing Electron Beam Patterns Using Expanded Beam Array", filed Dec. 7, 1979. The proper timing for the video information to the individual beams may be generated on the fly as though the video data were taken from successive line scans of a single beam scanner or conversely could be stored in memory with all requisite time delays built in whereby such data would be directly supplied to the individual control grids for each of the beams as will be well understood.

FIG. 2 assumes proper orientation of the matrix array to produce equal spacing of the 16 scan lines. It will be readily appreciated looking at the matrix in the left-hand portion of FIG. 2 (see also FIG. 4) that rotation of this matrix in a counterclockwise direction will cause various scan lines making up the groups 1–4, 5–8, etc., to become spaced further apart while lines 4 and 5, 8 and 9, and 12 and 13 will get closer and closer together until they finally overlap. Similarly, if the undesired rotation is clockwise the scan lines defined by beams 1–4, 5–8, etc., will become progressively closer together and the spacing between beams 4 and 5, 8 and 9, and 12 and 13 will become further apart until possibly only four scans could be produced by the 16 beams. In addition to the uneven distribution of scan lines, rotation causes extreme distortion of the displayed image. Thus, what should appear to be a vertical line as described above in generating the letter E would become a series of four diagonal segments wherein the slope of the diagonal would depend upon the direction of rotation of the matrix array. It is thus apparent that such distortion would produce an unacceptable display in a majority of situations.

As stated previously, it has been discovered that the use of a split focus coil, i.e., two coils placed very close to each other having their primary windings separately energizable, may be appropriately energized to produce opposing axial magnetic fields in the tube and thus control the rotation of the matrix array of beams. This field counteracts undesired rotation introduced by other components of the tube assembly, for example, such as the deflection yoke per se.

The present split focus coil provides the requisite corrective rotational field and, as is apparent from FIG. 1, is placed in substantially the same position as a single focus coil would be placed; that is, between the deflection yoke and the cathode adjacent to the deflection yoke.

It has been found that by suitably adjusting the currents that focus or spot size may be maintained while varying the rotation. As will be well understood, normally introducing changes in the magnetic field within the tube will have some effect on the focus. Thus, if it is assumed that the beams are focused on the screen before a corrective rotational field is applied, it may be assumed that there will be some deterioration of the focus due to the applied corrective rotational field. Specific means are provided to control the currents to also account for focusing variations. The way this is done in the presently disclosed system will be set forth more fully subsequently.

Figure 5:
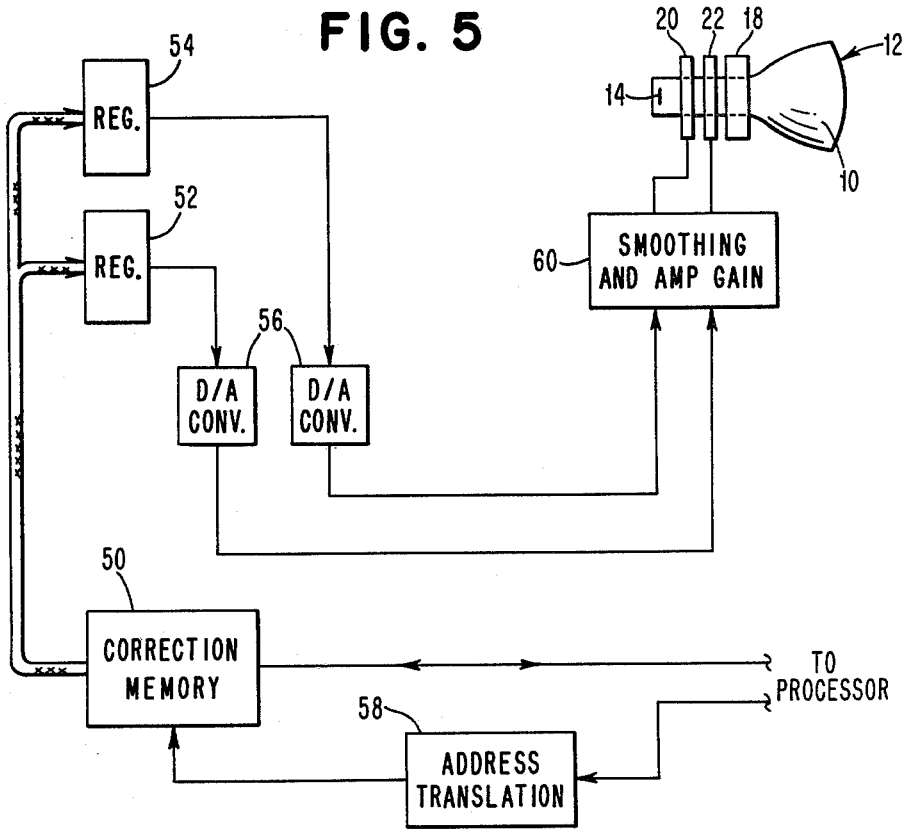
FIG. 5 is a functional block diagram of the essential elements of the dynamic signal source utilized for energizing the split focus coils.

Before proceeding with a description of FIG. 5 which is a functional block diagram of a digital storage and control system suitable for supplying the requisite corrective currents to the split focus coil of the present invention, a brief theoretical description of the operation of the present invention, is set forth.

Figure 3:
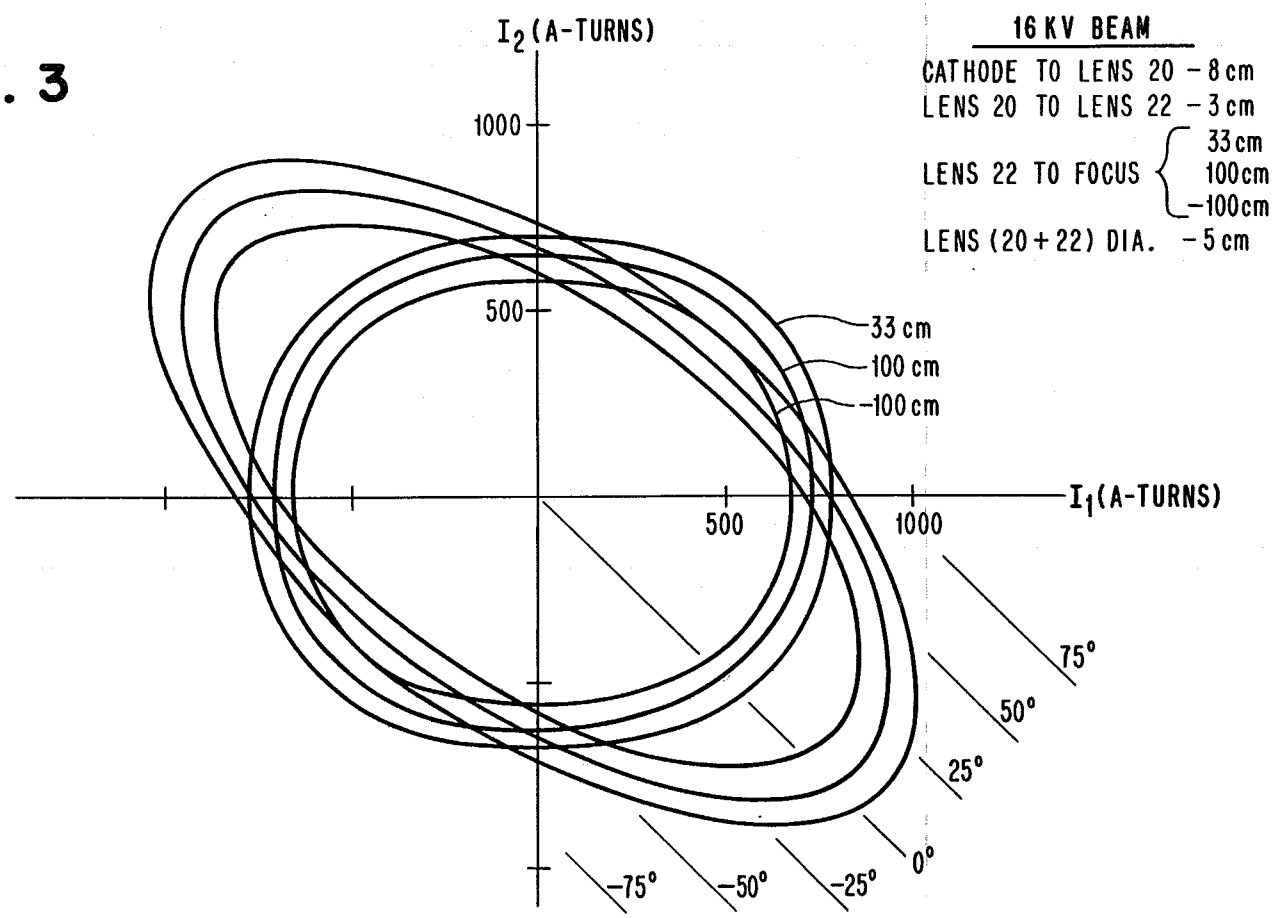
FIG. 3 is a graphical representation of the plot of $I_1$ and $I_2$ through the two split focus coils required to produce varying degrees of rotational correction with the focus maintained at the indicated focal planes.

If one plots the current in one of the two windings against the other when the beam is focused on a given surface, one will approximately generate a closed figure which is substantially elliptical as shown in FIG. 3. The eccentricity will depend on the coupling between the two lens fields.

The angle of the major axis will be exactly 45° when the overall magnification of the system is 1 and will change a few degrees when the magnification is changed. Changing the surface on which the beam is focused will change the overall size of the "ellipse". This is shown in FIG. 3. The "ellipses" were generated using a lens whose halves interacted. The "circular" figures were generated assuming the lens fields were noninteracting. The overall rotation introduced by the lens will be given by $$\chi(\text{rad}) = \frac{4\pi\,(I_1 + I_2)}{20\,\rho} \quad \text{where:}$$

$$\rho = 1704.526 \text{ Gauss cm} \times \sqrt{2\frac{e\phi}{m_o c^2} + \left(\frac{e\phi}{m_o c^2}\right)^2}$$

and $I_1$ and $I_2$ are in amp turns.

With $e\phi/m_o c^2$ the dimensionless ratio of the kinetic energy of the electron to its rest mass. Convenient units to use are $\phi$ in volts and $m_o c^2$ in electron volts (~511,000).

There is a slight error in $\chi$ in this formula as it includes a small amount of rotation occurring beyond the source and the screen.

It can be seen that if one operates with $I_1$ and $I_2$ nearly equal in magnitude, but of opposite sign, the curves of constant focal surface are nearly orthogonal to the lines of constant rotation. Therefore, if one changes $I_1$ and $I_2$ so their sum is constant one can change the focus without affecting the rotation. If one increases (or decreases) $I_1$ and $I_2$ by the same amount, the rotation will change while substantially remaining on the same constant focus curve. This could easily be achieved by mixing the windings on the half-coils so that one winding would increase both $I_1$ and $I_2$ (being wound in the same sense on the two halves) while the other would be wound in opposite senses on the two halves.

Figure 4:
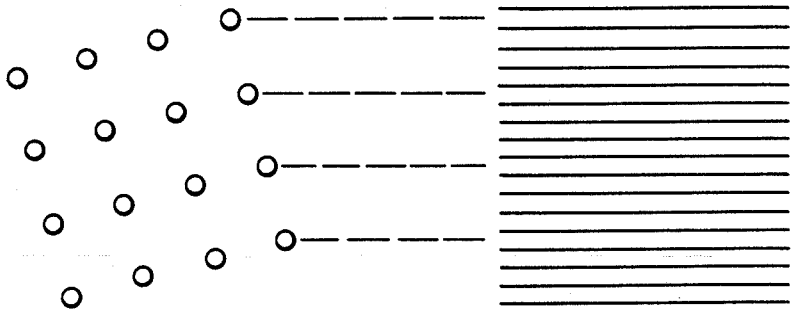
FIG. 4 illustrates a display sequence utilized in generating the dynamic correction signals.

Using a coil wound in this way, the current needed to achieve dynamic focus will vary approximately as the square of the distance of the beam from the center of the screen. The current needed to correct rotation error will be very small since the rotation error will be, at most, a few degrees. This current will also vary approximately as the square of the distance of the beam from the screen center. Because these variations are similar to those in the digital color convergence system set forth and described in the article by Beeteson et al. entitled "Digital System for Convergence of Three-Beam High-Resolution Color Data Displays," in the IBM Journal of Research and Development, Vol. 24, No. 5, Sept. 1980, the same system can be used to fill the correction tables. As in the color convergence system, a pattern would be put on the screen in a number of zones. A suitable pattern is shown in FIG. 4. All beams would be turned on for an instant to generate the spots and then turned on later for a period of time to generate the set of scanned lines. The user would press one of 4 keys to either increase or decrease the excitation of either winding, one being wound in opposite senses and affecting focus but not rotation, and the other being wound in the same sense affecting rotation, but not changing focus (substantially).

The user would proceed from one zone on the screen to another zone under control of system software adjusting the focus and rotation. The correction table or memory would be filled as in the color convergence system set forth in the previously referenced article by Beeteson et al in the IBM Journal of Research and Development.

Basically, the user would manipulate the focus adjustments to obtain minimum spot size indicating the most precise and accurate focus. The rotation controls would be adjusted to give even spacing of the scan lines.

From the above description it will be apparent that there are two possible ways of winding the coils 20 and 22. The first and perhaps physically simpler, is to use a single winding on each coil and creating the opposing magnetic fields by supplying currents of opposite polarity to each of the coils. The alternative structure as suggested above, involves providing two separate sets of windings on the two halves of the split coil wherein the first set of windings produces fields in the same sense in each coil which will effect rotation of the bundle of beams but will not change the focus and providing a second set of windings wound so that they produce fields of an opposite sense in the two coils which may be suitably energized to effect focus but not rotation. This latter configuration makes adjusting the system somewhat easier from the standpoint of the controls and procedures an operator who was generating the corrective signals would have to implement. This is due to the fact that with the focus and rotation separately and independently controllable the operator may concentrate on the particular feature of the display he is trying to correct rather than having to be continuously cognizant of the fact that any change in rotation is going to cause a change in focus and vice versa. Also, the time involved in repetitively adjusting first rotation and then focus until a satisfactory pattern is produced would be considerably more time consuming and tedious. However, it should be clearly understood that either system would work satisfactorily. Regardless of which system were used, two currents, $I_1$ and $I_2$, have to be provided to the split focus coils continually as the scan is moved across the screen: (1) to a separate sole winding on each coil or (2) to two composite windings on both coils. The particular signal provided would be dependent on the particular area of the screen in which the scan was located. As with the color convergence corrective system of the Beeteson et al article, the corrective signals may be significantly quantized. That is, the horizontal scan may be broken up into, for example, 15 segments and the vertical scan broken up into 32 segments. This would produce a total of 480 separate zones on the face of this screen, for which corrective signals would have to be computed.

Thus, to load the appropriate corrective memory, the operator would initiate a diagnostic procedure wherein a test pattern such as shown and discussed previously with respect to FIG. 4 is projected on the screen in the appropriate zone area and the operator would make appropriate adjustments to develop a corrective signal which would provide desired focus and line separation (rotation correction). He would then depress a key which would cause the corrective signal in digital form to be stored at the appropriate address in the corrective memory. This procedure would, in effect, be repeated for all 480 segments and the system would then be appropriately adjusted and ready for operation.

It will be appreciated that for each corrective signal there would be two components, $I_1$ and $I_2$ which would represent, in digital form, the signal which must be supplied to the split focus coils 20 and 22 regardless of which of the two above described winding embodiments were utilized.

Thus, if the simpler winding scheme were used, current $I_1$ for example, would be utilized solely to energize coil 20 and current $I_2$ would be used to solely energize coils 22. It is, of course, understood that the particular magnitude of the two currents would have been appropriately adjusted by the operator to produce the desired rotational correction while maintaining focus.

If the more complex winding scheme were used as in the preferred embodiment, the current $I_1$ might represent that component of the total corrective signal which would effect only focus when passing from segment to segment whereas the current $I_2$ would effect only the rotation on passing from segment to segment.

It will, of course, be appreciated that the present signals stored in the corrective memory are in essence, a quantized waveform, such as shown in FIG. 9 on page 603 of the previously referenced Beeteson article. To avoid discontinuities in the scan it is necessary that these discontinuities be smooth which is the effect of the smoothing amplifier 60 shown in FIG. 5.

Referring specifically to FIG. 5, it comprises a functional block diagram of the digital control circuitry and storage system organized to continuously and dynamically supply the necessary corrective currents to the split focus coils 20 and 22. The hardware for this system is very similar to that disclosed in the Beeteson et al article.

The 480 corrective signals are stored in the correction memory 50 as described previously and the two signals representing the corrective currents $I_1$ and $I_2$, are read out in digital form into the two holding registers 52 and 54. The function of these registers is to hold the particular corrective digital signals representing the two currents while the beam is in that zone of the screen. Since the digital to analog converters 56 are continuously connected to these registers a suitably converted analog signal would be produced by the D/A converters 56 and in turn, supplied to the smoothing amplifier 58 from whence the two currents are supplied to the split focus coils 20 and 22. The next signal set stored in the memory 50 to be loaded into the two registers 52 and 54 will probably change in value and it is the obvious function of the smoothing amplifier to "smooth" these discontinuities. The address translation means 58 would operate in exactly the same way as in the Beeteson et al article in that it automatically synchronizes the addressing of the correction memory with the X and Y deflection signals supplied to the deflection yoke so that the appropriate portion of the memory is accessed relative to the position of the scan on the screen of the display tube 10.

It should also be understood that while the presently disclosed address translation system for the entire corrective mechanism is in essence designed for use with a continuous raster type display as utilized in conventional TV systems, that the same principles would apply if a more sophisticated, directly controlled, X-Y addressable system were utilized wherein various display figures may be generated directly by consecutive X-Y addresses to directly trace desired patterns on the tube. In this latter instance, the address translation circuitry would simply be connected to the address generating circuitry of the tube and the same correctional signals would be placed in the registers 52 and 54. They would of course change as the scan traverses from one screen zone to another.

Although a preferred embodiment of the present invention has been set forth and described herein, it will be readily appreciated that many changes could be made by those skilled in the art without departing from the spirit and scope of the present invention.

While a digital corrective signal storage and output system has been set forth and described, a completely analog storage system would suffice. Similarly, the storage addressing and memory buffers could take many other forms. For example, the quantized corrective signals could be preprocessed by smoothing, sampling, and storing a separate corrective signal for each pel position.

The above variations are intended to be exemplary only of various changes in the details of such a multiple beam cathode ray tube display system constructed in accordance with the teachings of the present invention.

INDUSTRIAL APPLICABILITY

The present invention has utility in any multi-beam cathode ray tube display system wherein a matrix array of electron beams is projected onto the screen of the display tube.

The invention is believed to provide a unique solution to the rotational distortion problem and thus make more practical the use of larger matrix arrays with an attendant increase in the bandwidth of data which can be received and displayed.

The corrective system is both straightforward and simple and utilizes well known concepts and techniques to achieve its goal. It is accordingly believed to be a significant contribution to the video CRT display area.

Having thus described my invention, what I claim as new, and desire to secure by Letters Patent is:

1. A display system including a multiple beam cathode ray display tube comprising an array of cathodes and beam forming means, for projecting a matrix array of electron beams onto the screen of said display tube, deflection means for simultaneously deflecting said bundle of electron beams to form a scanning pattern, means external to said tube disposed in electromagnetically interactive relationship with said bundle of electron beams for simultaneously focusing each of said electron beams of said bundle of electron beams and for rotating said bundle of electron beams by an amount sufficient to counter undesired rotational distortion of said bundle, said means including a pair of coils, each coil comprising a single winding, wound to selectively provide opposing axial magnetic fields, and means connected to said coils for supplying corrective signals thereto comprising means for dynamically energizing said coils as a function of the instantaneous location of said projected matrix array on the screen of said display tube.

2. A display system as set forth in claim 1 wherein said means for supplying corrective signals further comprises memory means storing said corrective signals and means for continuously accessing said memory in synchronism with the deflection of the bundle of electron beams whereby corrective signals accessed from said memory are directly related to the position of said matrix array of electron beams on the screen of said display tube at any point in time.

3. A display system as set forth in claim 2 wherein the two coils are wound so that each has two separately energizable windings and means for interconnecting one winding on each coil to produce magnetic fields of the same polarity and for interconnecting the other windings on each coil to produce magnetic fields of opposite polarity.

4. A display system as set forth in claim 3 wherein said coils are adjacent to each other and are located between the cathode array and said deflection means.

5. An apparatus for forming a multiple scan line electron beam pattern on the screen of a cathode ray display tube which substantially avoids or reduces mutual beam repulsion and beam intermodulation problems comprising, electron beam emitter means (14) for emitting a plurality of electron beams which are disposed in relation to each other so as to form a matrix array of beams, means (18) for deflecting each of said beams along a plurality of spaced apart, parallel scan lines, each said scan line being comprised of a plurality of successively disposed scanning positions of a particular beam, said array of beams being such that at any one time each beam lies on a different scan line, split contiguous focus coil means each having at least one winding for selectively producing opposed axial magnetic fields within said tube and, means comprising memory means addressable as a function of the instantaneous beam deflection signals for dynamically supplying corrective signals to said two split focus coil windings which are a function of the beam displacement to simultaneously correct for rotational distortions of said matrix array of beams and maintain optimal focus of said beams.

6. The apparatus of claim 5 wherein said split focus coil comprises two separate contigious coil structures located around the neck of said cathode ray tube between the cathode structure and the deflection means and wherein each coil includes has a first interconnected layer which, when energized by a first current controls the axial location of the focus plane of said matrix array of electron beams without affecting the rotation of said matrix array and wherein each coil has a second layer so interconnected that current therethrough causes rotation of the matrix array without changing the focus of said array.

7. A method for forming a multiple scan line electron beam pattern which substantially avoids or reduces mutual beam repulsion and beam intermodulation problems, comprising the steps of, forming a plurality of electron beams which are disposed in relation to each other so as to form an M by N matrix array of beams, wherein both M and N are greater than 1 unit and wherein a unit is equal to the minimal spacing between two adjacent beams, deflecting each of said beams along a plurality of spaced apart, parallel scan lines, each said scan line being comprised of a plurality of successively disposed scanning positions of a particular beam, said array of beams bieng such that at any one time each beam lies on a different scan line and dynamically correcting for rotational distortion of said array of beams by providing two selectively opposing axial magnetic fields within the neck of said tube between the cathode structure and the deflecting means therefor wherein said step of dynamically correcting comprises supplying predetermined corrective signals from a previously loaded memory means.

8. A display system including a multiple beam cathode ray display tube comprising an array of cathodes and beam forming means, for projecting a matrix array of electron beams onto the screen of said display tube, deflection means for simultaneously deflecting said bundle of electron beams to form a scanning pattern, means external to said tube disposed in electromagnetically interactive relationship with said bundle of electron beams for simultaneously focusing each of said electron beams and for rotating said bundle of electron beams by an amount sufficient to counter undesired rotational distortion of said bundle, said means including a pair of coils wound to selectively provide opposing magnetic fields, and means connected to said coils for dynamically supplying corrective signals to said coils as a function of the displacement of said matrix array of beams on said screen from a storage means in which predetermined corrective signals are stored and, means for accessing said storage means as a function of the displacement of said matrix array of beams.

* * * * *